US007020299B2

(12) United States Patent
Niederdränk

(10) Patent No.: US 7,020,299 B2
(45) Date of Patent: Mar. 28, 2006

(54) CERUMEN PROTECTION SYSTEM FOR HEARING AIDS

(75) Inventor: Torsten Niederdränk, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 168 days.

(21) Appl. No.: 10/394,953

(22) Filed: Mar. 21, 2003

(65) Prior Publication Data

US 2003/0198360 A1 Oct. 23, 2003

(30) Foreign Application Priority Data

Mar. 27, 2002 (DE) ..... 102 13 844

(51) Int. Cl.
*H04R 25/00* (2006.01)

(52) U.S. Cl. ..... 381/370; 381/325; 381/328; 381/380

(58) Field of Classification Search ..... 381/322, 381/324, 325, 326, 327, 328, 368, 370, 380; 181/129, 130, 135
See application file for complete search history.

(56) References Cited

U.S. PATENT DOCUMENTS 4,972,488 A * 11/1990 Weiss et al. ..... 381/325
4,987,597 A * 1/1991 Haertl ..... 381/325
5,530,763 A * 6/1996 Aebi et al. ..... 381/322
5,887,070 A * 3/1999 Iseberg et al. ..... 381/380

FOREIGN PATENT DOCUMENTS

DE PS 199 08 854 9/2000

* cited by examiner

*Primary Examiner*—Huyen Le
(74) *Attorney, Agent, or Firm*—Schiff Hardin LLP

(57) ABSTRACT

Cerumen are effectively kept away from the earphone of a hearing aid by the earphone having a lager lateral sound exit opening partly covered by a band. Polytetrafluoroethylene film is suited as material for the band. For protection against larger cerumen constituents, the earphone can be additionally encapsulated by a capsule having a cover. To this end, the earphone is seated in the capsule vibration-damped by means of damping elements.

11 Claims, 1 Drawing Sheet

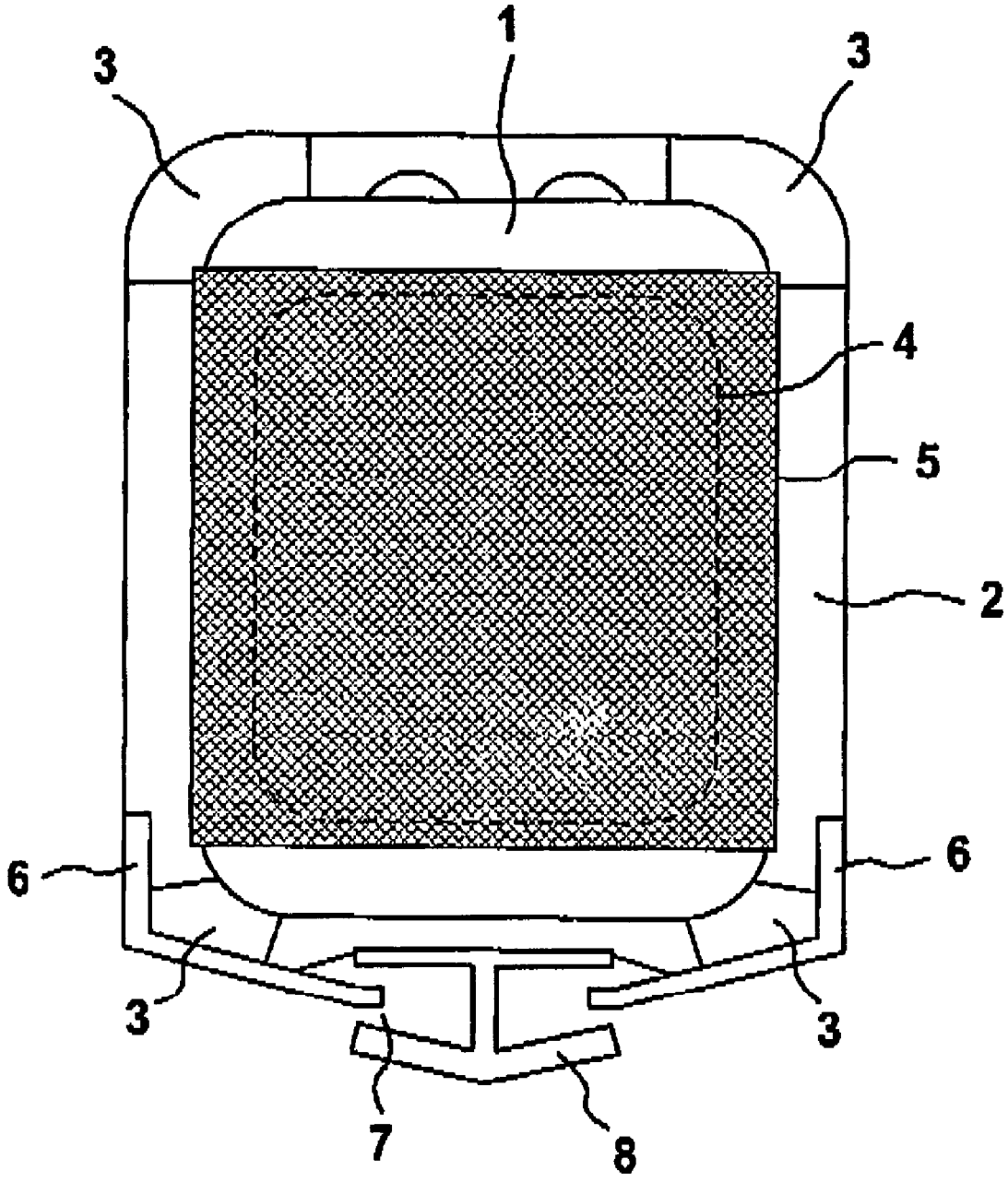
1
3
3
4
5
2
6
6
3
3
7
8

CERUMEN PROTECTION SYSTEM FOR HEARING AIDS

BACKGROUND OF THE INVENTION

1. Field of the Invention

The present invention is directed to an earphone device that can be introduced into an auditory canal, having a speaker device with a sound exit opening. The present invention is particularly directed to such an earphone device with a cerumen protection system that protects it against invasive cerumen.

2. Description of the Prior Art

Due to the production of cerumen in the ear canal, outages of hearing aids or damage to the electro-acoustic transducers thereof occur for hearing aid wearers due to blockage of the acoustic channel. The chemically aggressive cerumen is composed of gaseous, fluid and nearly solid constituents. Protection against cerumen is therefore desirable that is able to prevent (to the extent possible) penetration of cerumen into the sound channel while being easy to clean despite contamination that has penetrated.

A number of cerumen protection solutions are available in the hearing aid market. There are a number of solutions that mechanically prevent penetration of cerumen and assure a good ability to clean the sound channel. Open-pore membranes also are utilized but these must leave the acoustic properties of the hearing aid nearly uninfluenced. These, however, have the disadvantage that gaseous and fluid constituents can penetrate or at least plug the cerumen protection system. This results in that immediate cleaning or a replacement being required.

Other cerumen protection systems employ absolutely tight membranes that are typically arranged at the tip of the hearing aid shell the side thereof facing toward the tympanum of such membranes, for assuring the least possible acoustic attenuation, exhibit less of a good mechanical stability and a structural size that cannot be ignored and that can lead to problems in the manipulation and in the supply rate given small canal devices. For good acoustic transmission properties, the membrane should be nearly without mass, i.e. it should exhibit an extremely small wall thickness, and also should have a large area.

German Patent 199 08 854 discloses an auditory canal insert for hearing aid devices in this context. The auditory canal insert has a sound channel, a cerumen protector being arranged in front of its sound channel opening facing toward the tympanum. The cerumen protector is composed of a sound-transmissive membrane injected into a core of the hearing aid insert. This cerumen protection system, however, is uncomfortable to use.

SUMMARY OF THE INVENTION

An object of the present invention is to provide an improved cerumen protection system for hearing aids or earphones.

This object is inventively achieved by an earphone device that can be introduced into an auditory canal, having a speaker device that with a sound exit opening and a band that is attached such over the speaker device that at least partly covers the sound exit opening.

The band is composed of an elastic material, so that it can be stretched over the sound exit opening of the speaker device. When the band is implemented as a section of a tube, then it can be pulled over the speaker device and can be properly mounted without great outlay.

So that the band exhibits a lowest possible acoustic attenuation, it should be nearly without mass in the region of the sound exit opening. Bands having a wall thickness of less than 0.1 mm essentially satisfy these requirements.

The band preferably is composed of a chemically resistant material such as Teflon®. When the band is composed of an open-pore material, this has the advantage that the band can be pulled completely over the sound exit opening without a specific opening for a static pressure compensation.

Earphones in hearing aids usually have an oblong shape, with a sound exit connector for conducting the sound to the tympanum being provided at one of the end faces. Inventively, however, a sound exit opening over which a band can be pulled is employed at the earphone. If the area of the sound exit opening is too small, the band or membrane stretched over the sound exit opening has too much stiffness, which leads to high sound attenuations. It has been shown that sound exit openings having an area greater than 4 $mm^2$ are preferred given a closed-pore membrane. Such large sound exit openings usually can be realized only at one of the long sides of the earphone or speaker device.

The earphone or speaker oscillates when generating sound. It is therefore meaningful to seat the earphone in a housing, particularly the hearing aid housing, in buffered fashion. This can ensue by means of damping elements at the corners of the earphone, or by means of the band that is arranged between the earphone and the housing.

In order to further enhance the cerumen protection, the earphone can be accommodated in a specific encapsulation that in turn has an exit opening for the sound output that is mechanically protected against penetrating cerumen. To this end, the encapsulation can be composed of a container into which the earphone is inserted and that is closed with a cover. The cover can be composed of a plastic material and include exit opening.

The mechanical protection of the exit opening against the penetration of cerumen preferably is realized by a plunger that is movably accommodated in the opening. Cerumen that has penetrated into the exit opening thus can be removed by lifting or pressing the plunger.

DESCRIPTION OF THE DRAWINGS

The FIGURE shows a partially sectional view of an inventive, encapsulated earphone.

DESCRIPTION OF THE PREFERRED EMBODIMENTS

The cerumen protection system shown in the FIGURE is essentially composed of two components. A hearing aid earphone 1 is suspended in a separate capsule 2 in vibration-inhibiting fashion with damping elements 3. This capsule 2 can be either a separate part or can be included as part of the hearing aid shell when manufacturing the shell.

The earphone 1 has a lateral sound exit opening 4 instead of the exit connector that is usually employed. A band 5 of highly elastic and nearly mass-free material is pulled over the earphone 1. For example, the band 5 is composed of a very thin tube composed of a Teflon® film. By pulling the tube over the entire earphone 1, the cerumen protection covering can be easily mounted on the earphone 1. It is particularly advantageous that the membrane can be stretched in front of the opening 4 without a frame in this way.

The inside of the earphone 1 is closed nearly airtight by the membrane or tube, so that penetration of cerumen constituents into the sensitive earphone is prevented. If the membrane is not composed of an open-pore material, then the opening 4 should not be completely covered by the membrane. A very slight leakage should be allowed in order to enable a static compensation of the air pressure. In practice, this is often achieved by a small, additional compensation (bleed off) opening at the earphone housing.

The sound exit opening 4 of the speaker or of the earphone 1 should be selected as large as possible so that the membrane stretched over the opening is not too stiff and thus does not attenuate the emerging sound too much. Transmission measurements have shown that the sound exit opening 4 should have a size of at least 4 $mm^2$ in view of the films that are available. Since such an area usually does not exist at the end face of an oblong earphone 1, the sound exit opening 4 is provided at a sidewall of the earphone 1.

The membrane or band 5 in fact keeps cerumen away from the earphone 1; for a longer-lasting protection, however, it is advantageous far larger cerumen quantities also to be kept away from the membrane 5. The reason for this is that quantities of cerumen that adhere to the membrane cause additional attenuation. As already explained, the earphone 1 is additionally introduced into an encapsulation 2 in which it is seated in vibration-damping fashion. This capsule 2 is closed by a cover 6 that itself has a sound exit opening 7. The cover 6 also serves as a support for the damping elements 3.

As a result of its mechanical design, the sound exit opening 7 prevents the penetration of cerumen and allows a simple cleaning of the sound exit opening. A plunger 8 that is suspended in bi-stable (two state) fashion and that is preferably composed of a permanently elastic plastic is situated in the sound exit opening shown in the FIGURE. For cleaning, the plunger 8 is pulled out and manually wiped off. Subsequently, the plunger 8 is pressed back in. If, contrary to expectations, cerumen were to penetrate into the earphone capsule 2, the acoustician can remove the cover 6 of the encapsulation and clean it in an ultrasound bath or the like. The membrane 5, however, prevents cerumen from penetrating directly into the earphone 1.

This combination of a membrane that seals the earphone with an arrangement that prevents the penetration of coarse cerumen particles, such as, for example, the encapsulation, effectively keeps all cerumen constituents away from the earphone 1.

Dependent on the material selected and on the selection of the wall thickness of the band 5, this can be simultaneously used as damping element for damping the earphone 1 relative to the capsule 2. In this context, for example, the wall thickness of the tube or the band 5 can be selected smaller at the side that covers the sound exit opening 4 than in other areas. The band 5 thus can assume multiple functions.

Although modifications and changes may be suggested by those skilled in the art, it is the intention of the inventor to embody within the patent warranted hereon all changes and modifications as reasonably and properly come within the scope of his contribution to the art.

I claim as my invention:

1. An earphone device adapted for introduction into an auditory canal, comprising a speaker device having a housing with opposite ends connected by a lateral wall, said later wall having a sound exit opening at an exterior surface thereof, and a tubular band attached over said housing of said speaker device and having a band portion completely covering said sound exit opening, said tubular band completely surrounding said lateral wall of said housing of said speaker device, said band portion being comprised of material exhibiting substantially no sound attenuation, and said tubular band having a tube axis substantially parallel to said exterior surface.

2. An earphone device as claimed in claim 1 wherein said band is comprised of an elastic material.

3. An earphone device as claimed in claim 1 wherein at least said band portion has a wall thickness of less than 0.1 mm.

4. An earphone device as claimed in claim 1 wherein said band comprises a membrane.

5. An earphone device as claimed in claim 4 wherein said membrane is comprised of polytetrafluoroethylene.

6. An earphone device as claimed in claim 1 wherein said band is comprised of an open-pore material.

7. An earphone device as claimed in claim 6 wherein said sound exit opening and said band portion covering said sound exit opening have an area larger than 4 $mm^2$.

8. An earphone device as claimed in claim 1 further comprising an exterior capsule and a mechanical damping device mounting said speaker device housing in said exterior capsule with mechanical vibration damping.

9. An earphone device as claimed in claim 8 wherein said band comprises a further band portion forming said damping device, said further band portion not including said band portion covering said sound exit opening.

10. An earphone device as claimed in claim 8 wherein said exterior capsule has an exit opening, and a cerumen protector disposed at said exit opening allowing sound to exit to an exterior of said exterior capsule through said exit opening and protecting against penetration of cerumen into said exterior capsule.

11. An earphone device as claimed in claim 10 wherein said cerumen protector comprises a plunger disposed so as to be movable in said exit opening.

* * * * *